US009447590B2

(12) United States Patent
Sighinolfi

(10) Patent No.: US 9,447,590 B2
(45) Date of Patent: Sep. 20, 2016

(54) LEVELLING SPACER DEVICE FOR LAYING SLAB PRODUCTS FOR CLADDING SURFACES

(71) Applicant: RAIMONDI S.P.A., Modena (IT)

(72) Inventor: Riccardo Sighinolfi, Reggio Emilia (IT)

(73) Assignee: RAIMONDI S.P.A., Modena (IT)

( * ) Notice: Subject to any disclaimer, the term of this patent is extended or adjusted under 35 U.S.C. 154(b) by 0 days.

(21) Appl. No.: 14/892,167

(22) PCT Filed: May 30, 2014

(86) PCT No.: PCT/IB2014/000918

§ 371 (c)(1),
(2) Date: Nov. 18, 2015

(87) PCT Pub. No.: WO2014/195780

PCT Pub. Date: Dec. 11, 2014

(65) Prior Publication Data

US 2016/0090746 A1 Mar. 31, 2016

(30) Foreign Application Priority Data

Jun. 4, 2013 (IT) ..... RE2013A0039

(51) Int. Cl.
*E04F 21/00* (2006.01)
*E04F 21/18* (2006.01)

(52) U.S. Cl.
CPC ..... *E04F 21/0092* (2013.01); *E04F 21/18* (2013.01)

(58) Field of Classification Search
CPC ..... E04F 21/00; E04F 21/0092; E04F 21/18
USPC ..... 33/526, DIG. 20
See application file for complete search history.

(56) References Cited

U.S. PATENT DOCUMENTS

| | | | | |
|---|---|---|---|---|
| 4,112,636 | A | 9/1978 | Hays | |
| 5,010,654 | A * | 4/1991 | Funes, Jr. | E04F 21/0092 33/526 |
| 8,671,628 | B2 * | 3/2014 | Sighinolfi | E04F 21/0092 33/527 |
| 8,887,475 | B2 * | 11/2014 | Ghelfi | E04F 21/0092 52/749.11 |
| 2002/0144421 | A1 * | 10/2002 | Hanson | E04F 21/0092 33/613 |
| 2016/0090746 | A1 * | 3/2016 | Sighinolfi | E04F 21/18 33/526 |

FOREIGN PATENT DOCUMENTS

EP 2565346 A1 3/2013

* cited by examiner

*Primary Examiner* — Yaritza Guadalupe-McCall
(74) *Attorney, Agent, or Firm* — Volpe and Koenig, P.C.

(57) ABSTRACT

A levelling spacer device (10) for laying slab products (P) for cladding surfaces, which device (10) comprises a base (20), positionable on a backside of a laying surface of at least two slab products (P) that are adjacent and flanked with respect to a flanking direction (A), at least a separator element (30) emerging from the base (20), able to contact the facing flanks of the two slab products (P), and mobile between a storage position in which it lies substantially parallel to the base (20) and a work position in which it emerges substantially perpendicular to the base (20); the peculiarity of the device consisting in the fact of comprising blocking means (250, 311) of the separator element (30) in the work position.

14 Claims, 10 Drawing Sheets

LEVELLING SPACER DEVICE FOR LAYING SLAB PRODUCTS FOR CLADDING SURFACES

TECHNICAL FIELD

The present invention relates to a levelling spacer device for laying slab products, natural slab products and the like, for cladding surfaces, such as treadable surfaces, floors, wall coverings or ceilings and the like.

PRIOR ART

In the sector of laying tiles for cladding surfaces, such as floors, walls and the like, the use of spacer devices is known, which not only space the tiles but enable planar arrangement thereof. These devices are commonly known as levelling spacer devices.

The levelling spacer devices of known type generally comprise a base, positionable below the laying surface of at least two adjacent tiles, from which at least a separator element emerges, able to contact, by means of the lateral flanks thereof, the facing flanks of the two tiles to be laid side-by-side on the laying surface.

The levelling spacer device is also provided with presser means able to press the in-view surface of the products toward the base in such a way as to level, cooperating with the portion of the separator element which emerges above the plane defined by the in-view surface of the tiles.

Among the various levelling spacer devices of known type there are some in which the separator element is mobile between a space-saving storage position, in which it is substantially coplanar to the base plane, and an operative work position, in which it emerges substantially squared from the base.

Examples of known levelling spacer devices of known type are described in patent application no. MO2002A000035 in the name of the present Applicant. These levelling spacer devices, while on the one hand enabling reduction of the spatial volume thereof, also enable a more rational and efficient storage and transport thereof, with consequent beneficial repercussions on the relative costs; however they exhibit the drawback of being less handy to use for the personnel doing the laying, as once the separator element is positioned in the working position it does not remain in the desired position (squared with the base) but is free to return, even only by a limited angle, towards the storage position, for example by effect of a certain intrinsic elasticity of the material of which the levelling spacer device itself is made. Further, the inclined or slightly inclined arrangement of the separator element does not enable the exact positioning of the tiles in the area of the device itself, defining therefore spaces between the tiles which are not perfectly regular and this is a problem for the positioning of the tiles which flank the tiles already laid.

An aim of the present invention is to obviate the above-mentioned drawbacks of the prior art, with a solution that is simple, rational and relatively inexpensive.

The aims are attained by the characteristics of the invention reported in the independent claim. The dependent claims delineate preferred and/or particularly advantageous aspects of the invention.

DESCRIPTION OF THE INVENTION

The invention in particular discloses a levelling spacer device for laying slab products for cladding surfaces, which device comprises a base, positionable on a backside of a laying surface of at least two slab products that are adjacent and flanked with respect to a flanking direction, from which at least a separator element emerges joined to the base, able to contact the facing flanks of the two slab products, and mobile between a storage position in which it lies substantially parallel to the base and a work position in which it emerges substantially perpendicular to the base.

In the invention the levelling spacer device comprises blocking means of the separator element in the work position.

With this solution, the device can be produced and stored in such a way as to reduce volumes thereof, as well as reducing plant, storage and transport costs, while at the same time providing a device that is easy to use for the personnel carrying out the laying of the slab products in comparison with devices with a fixed separator element.

The blocking means advantageously comprise at least an abutting shelf fixed to at least one from between the base and the separator element able to interfere, for example when the separator element is in the work position, with at least a hooking element solidly constrained to the other of the separator element and the base, so as to prevent the spontaneous return of the separator element towards the storage position.

With this solution the blocking means can be defined simply and rationally and can be made in a single piece with the elements constituting the levelling spacer device.

In a further aspect of the invention, the hooking element comprises a flexible elastically yielding plate projecting in cantilever fashion from at least one from between the separator element and the base and able to snap-fit by resting on the abutting shelf when the separator element is in a work position such as to prevent a spontaneous return of the separator element into the storage position.

In this way, thanks to the snap-engagement the blocking of the separator element in the work position is achieved rapidly and simply for the operator, as well as releasably if this becomes necessary.

Alternatively, the hooking element and the abutting shelf are able to joint by mechanical interference, being substantially flanked to one another when the separator element is in the work position, such as to prevent, by reciprocal friction, a spontaneous return of the separator element into the storage position.

In a further aspect of the invention, the separator element is joined to the base by means of a fold line able substantially to define a hinge.

In practice, the separator element is rotatably coupled to the base.

Further, the separator element, during the movement from the work position, describes an arc of about 90°.

The hinge line, during the movement (rotation) from the storage position to the work position of the separator element, deforms according to an elastic deformation or a combination of plastic deformation and elastic deformation, for example such that if the separator element is released (prior to the blocking) it spontaneously returns (elastically) towards the storage position, for example into an intermediate (and distinct) position with respect to the storage position and the work position.

The blocking means are configured so as to oppose the portion of elastic deformation of the hinge line which would tend to spontaneously return the separator element towards the storage position, substantially blocking the separator element in the work position, i.e. squared and rising from the base. The fold line is advantageously made by a substantially V-shaped cut realised in the join point between the separator element and the base, which for example is further able to define a tapered zone which defines a line or section that is predisposed to break and enables separation between the separator element and the base. Further, the pre-weakened line or section and/or the fold line is advantageously arranged at a height comprised within the thickness of the base with undoubted advantages in production terms of the device and the detachment of the separator element.

In a further aspect, the levelling spacer device of the invention comprises presser means associable to the separator element and able to press the in-view surface of the slab products towards the base such as to level the products.

The presser element can be of any type, as known to the expert in the sector. The separator element advantageously comprises a slab body fixed to the base, provided with a through-window, an upper edge of which, when in the operative work position, is destined to be positioned superiorly at the level of the in-view surface of the slab products; in this case the presser means comprise a wedge element insertable internally of the window and restingly slidable on the in-view surfaces of the slab products in cooperation with the upper edge for pushing the slab products towards the base.

In this way the system composed of the device and the wedge element is particularly easy and rapid to use for the personnel laying the slab products, for example by use of simple manually-activated pliers.

In a further aspect of the invention, the device can comprise a corner spacer which emerges from the base at an angle with respect to the separator element and is able to come into contact with the flanks perpendicular to the facing flanks of the slab products such as to align the slab products along a direction that is perpendicular to the flanking direction.

Thanks to this various levelling spacer devices can be realised, which can be used respectively at the lateral edges of due slab products to be flanked, at the corners of 3 or 4 products to be arranged squared.

The corner spacer is advantageously mobile between a raised position, in which it projects superiorly of the base, and a non-interfering position with the perpendicular flanks of the slab products.

With this solution, the levelling spacer element can be used both at the lateral edges of two slab products to be flanked and at the corners of the products to be arranged in a squared fashion, independently of the laying pattern of the products, while at the same time carrying out a levelling function for the products laid and a function of spacing the laid products with respect to one another.

In particular, the angular spacer is aligned with the window along a parallel direction to the flanking direction.

In a further aspect of the invention the base comprises at least a through-hole exhibiting a variable section along the thickness of the base and decreasing from the surface of the base destined to go into contact with the laying surface of the slab products towards the opposite surface of the base. With this solution, the levelling spacer device described above can be used not only for the laying of floors or walls, in which the glue can penetrate internally of the through-hole, improving the grip of the tile, but also for the laying of slab products for the covering of ceilings, as the countersunk through-hole provides an abutting surface for a fastening organ (screw, nail or like fastening organs) comprised in the base thickness, i.e. between the surface of the base destined to go into contact with the laying surface of the slab products and the opposite surface of the base.

In a further aspect of the invention, protectable also independently with respect to the foregoing, a levelling spacer device is disclosed for laying slab products for cladding surfaces which comprises a base, positionable on a backside of a laying surface of at least two slab products that are adjacent and flanked with respect to a flanking direction, from which at least a separator element emerges joined to the base, substantially squared (in use) to the base and able to contact the facing flanks of the two slab products; the device being characterised in that the base comprises at least a through-hole exhibiting a variable section along a thickness of the base and decreasing from the surface of the base destined to go into contact with the laying surface of the slab products towards the opposite surface of the base.

With this solution, it is possible to use the levelling spacer device also for laying slab products for cladding ceilings, as the countersunk through-hole makes available an abutting surface for a fastening organ (a screw, a nail or like fastening organs) comprised in the base thickness, i.e. between the base surface destined to go into contact with the laying surface of the slab products and the opposite surface of the base.

In practice, a fastening organ can be inserted, invisibly, through the through-hole, a head of which fastening organ can fasten the tapered section of the through-hole against an abutting wall of the ceiling and be at the same time arranged internally of the thickness of the base, without projecting from the surface of the base destined to go into contact with the laying surface of the slab products, so that the base alone functions as an abutment for the levelling of the slab products.

Further, another aspect of the invention, protectable also independently with respect to what is described in the foregoing, discloses a levelling spacer device for laying slab products for cladding surfaces, which comprises:

a base, positionable on a backside of the laying surface of at least two adjacent and flanked slab products with respect to a flanking direction, from which at least a separator element emerges, substantially squared (in use) to the base and able to contact the facing flanks of the two slab products, the device being characterised in that the base comprises at least a through-hole exhibiting a variable section along the thickness of the base and decreasing from the surface of the base destined to go into contact with the laying surface of the slab products towards the opposite surface of the base; and at least a fastening organ, for example a screw or a nail or the like, destined to be inserted in the through-hole in such a way as not to project from the surface of the base destined to go into contact with the laying surface of the slab products.

BRIEF DESCRIPTION OF THE DRAWINGS

Further characteristics and advantages of the invention will emerge from a reading of the description that follows, provided by way of non-limiting example, with the aid of the figures of the accompanying tables.

FIG. 28 is a lateral view of FIG. 27.

FIG. 29 is a view from above of FIG. 27.

FIG. 30 is an axonometric view of the levelling spacer device, according to the fourth embodiment of the invention, in the operative work position.

FIG. 31 is a lateral view of FIG. 30.

FIG. 32 is a view from above of FIG. 30.

BEST WAY OF CARRYING OUT THE INVENTION

Figure 3:
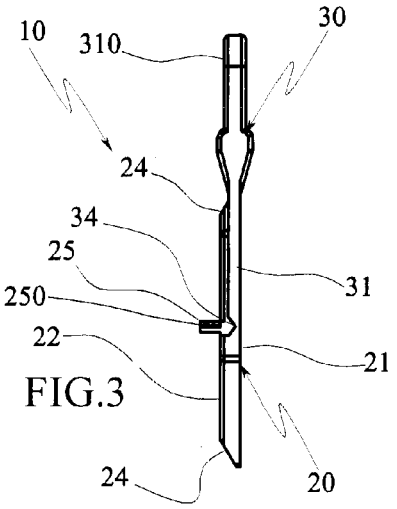
FIG. 3 is a lateral view of FIG. 1.
Figure 5:
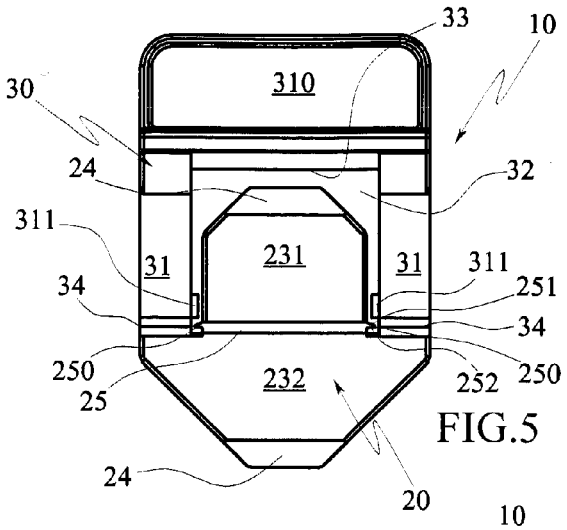
FIG. 5 is a view from above of FIG. 1.
Figure 1:
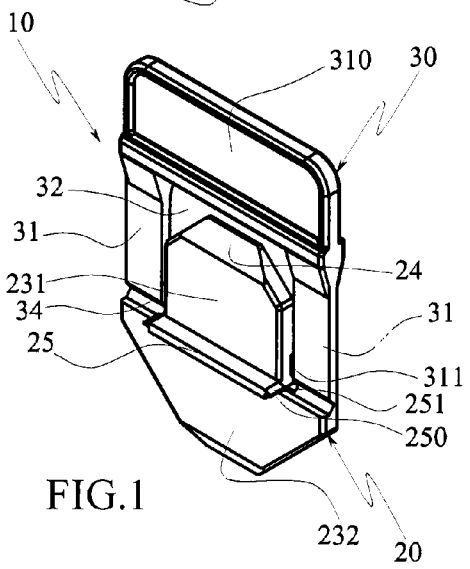
FIG. 1 is a first axonometric view of a first embodiment of a levelling spacer device, according to the invention, in the storage position.
Figure 2:
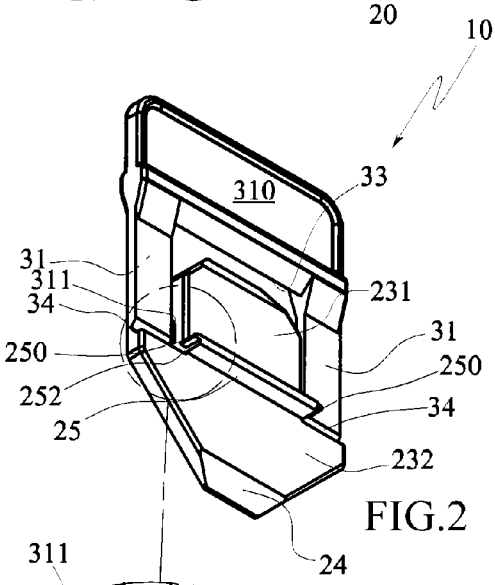
FIG. 2 is a second axonometric view of the levelling spacer device of FIG. 1.
Figure 4:
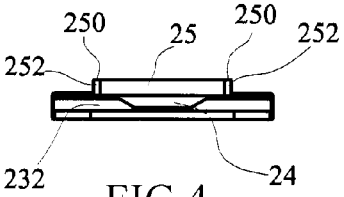
FIG. 4 is a front view of FIG. 1.
Figure 6:
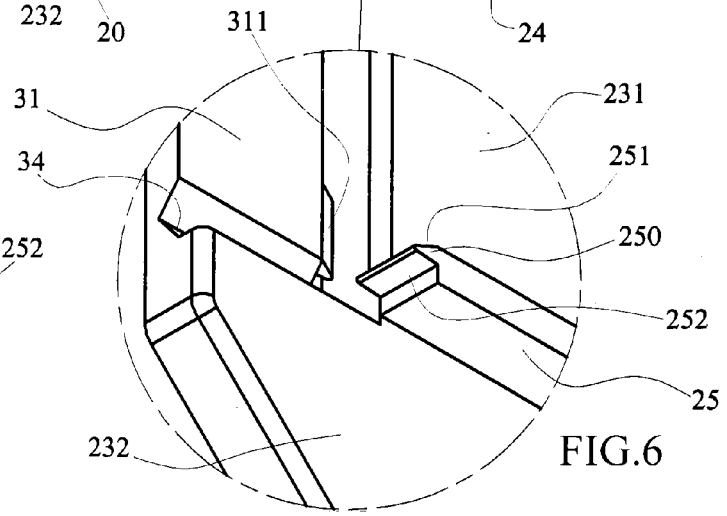
FIG. 6 is a larger-scale detail of FIG. 2.
Figure 9:
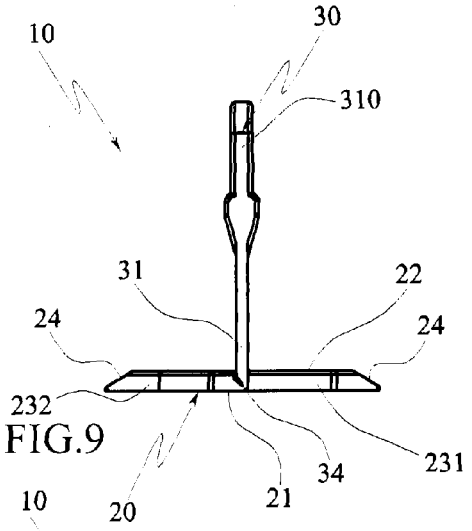
FIG. 9 is a lateral view of FIG. 7.
Figure 10:
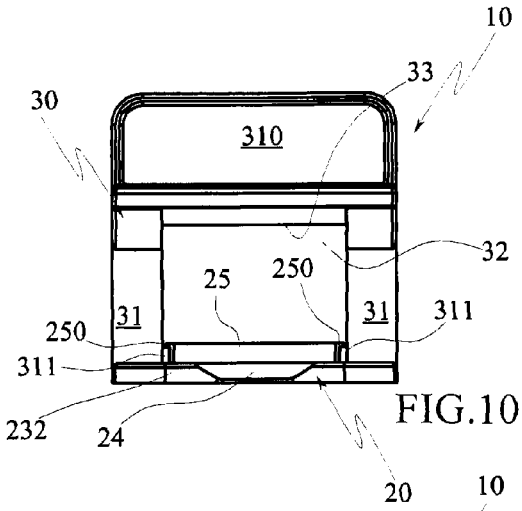
FIG. 10 is a front view of FIG. 7.
Figure 7:
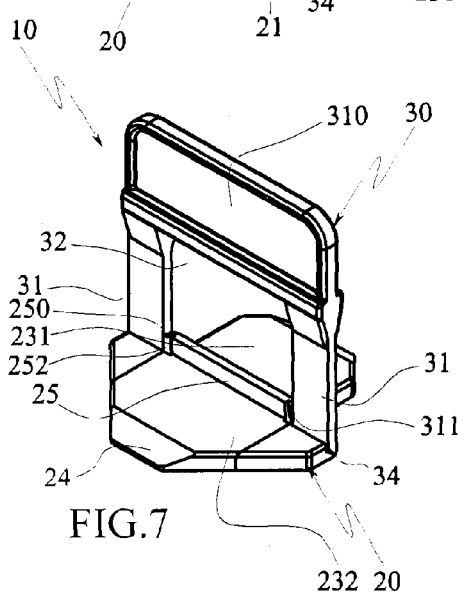
FIG. 7 is a first axonometric view of the levelling spacer device, according to the first embodiment of the invention, in an operator work position.
Figure 8:
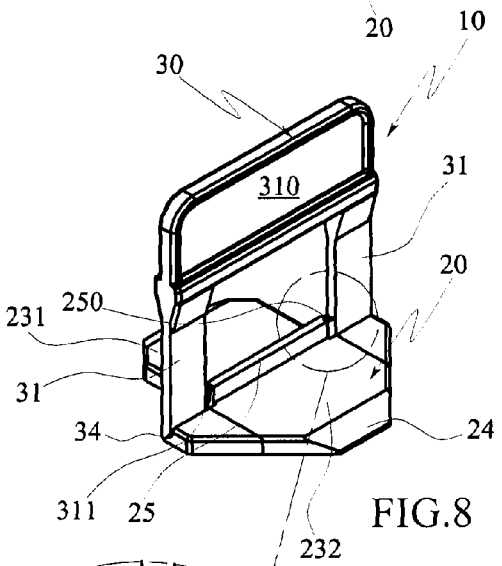
FIG. 8 is a second axonometric view of the levelling spacer device of FIG. 7.
Figure 11:
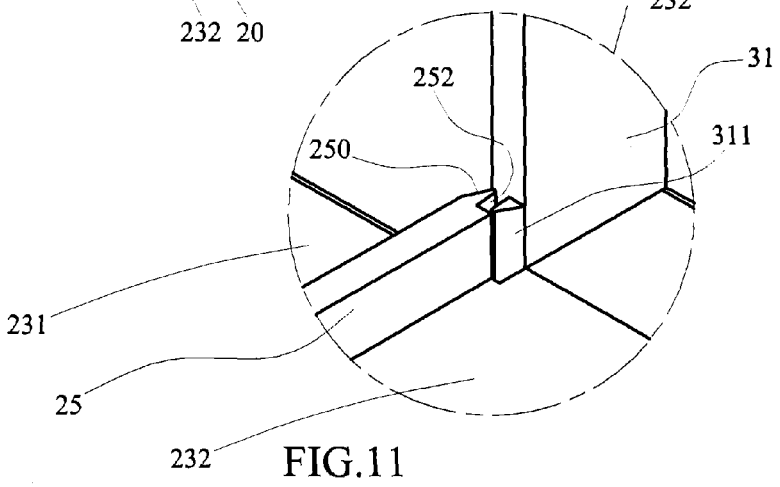
FIG. 11 is a larger-scale detail of FIG. 8.
Figure 12:
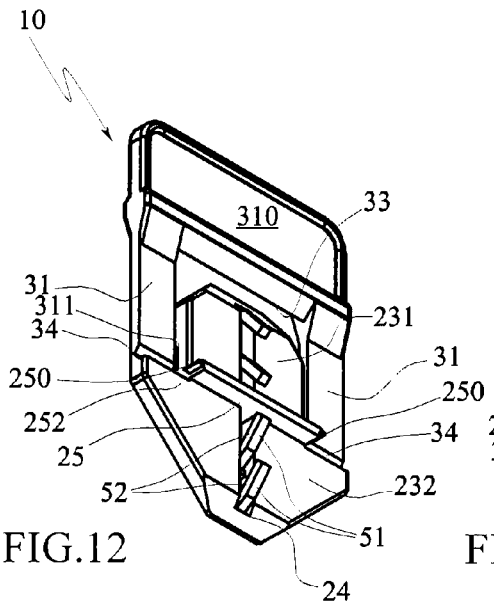
FIG. 12 is a first axonometric view of a second embodiment of a levelling spacer device according to the invention, in the storage position.
Figure 13:
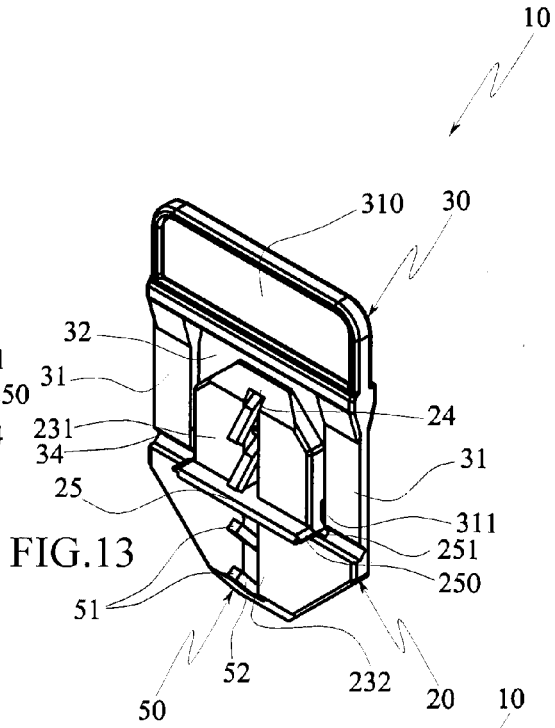
FIG. 13 is a second axonometric view of the levelling spacer device of FIG. 12.
Figure 14:
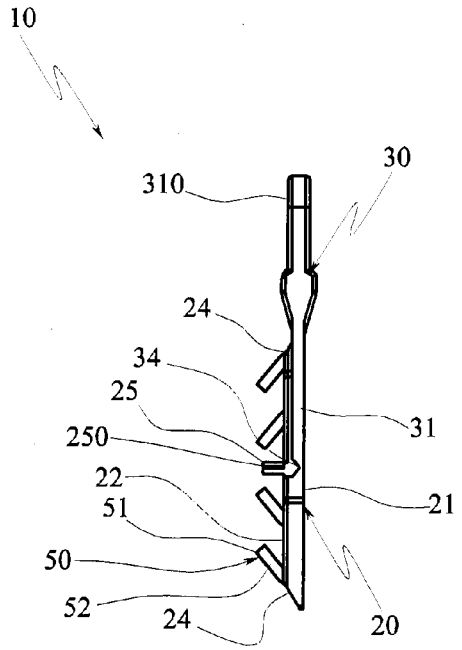
FIG. 14 is a lateral view of FIG. 12.
Figure 15:
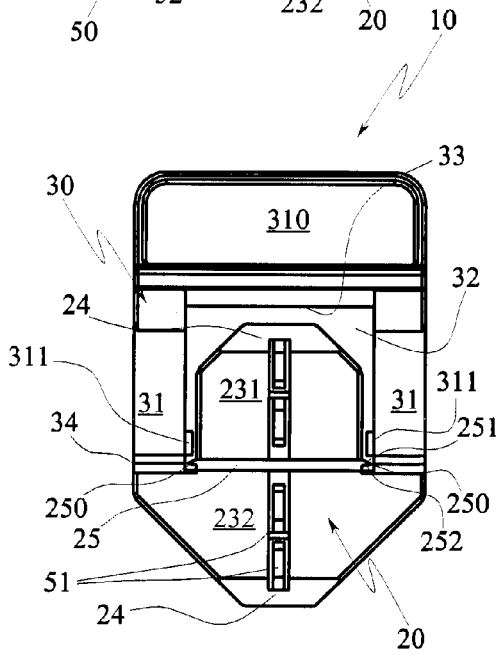
FIG. 15 is a view from above of FIG. 12.
Figure 16:
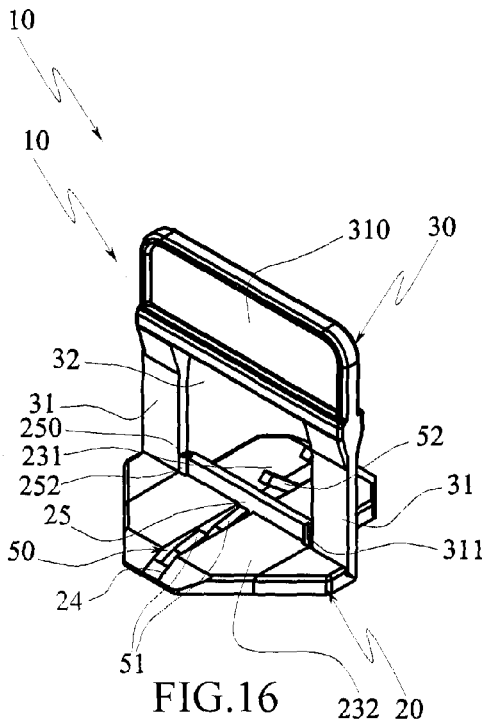
FIG. 16 is an axonometric view of the levelling space device according to the second embodiment of the invention, in the operative work position.
Figure 18:
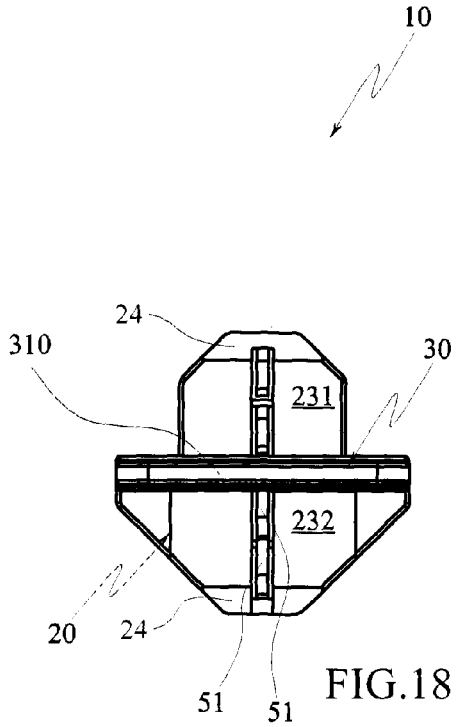
FIG. 18 is a view from above of FIG. 16.
Figure 17:
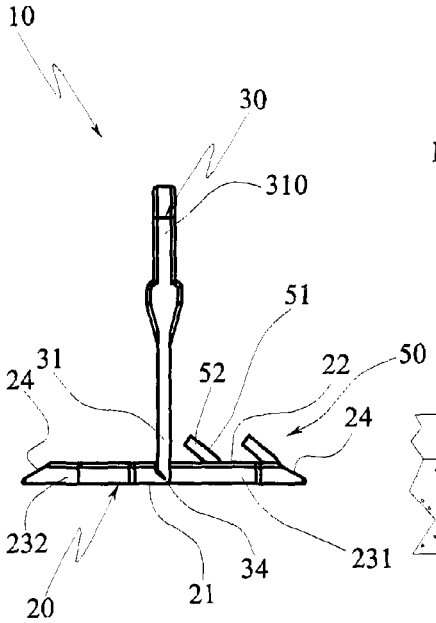
FIG. 17 is a lateral view of FIG. 16.

With particular reference to the figures, 10 denotes in its entirety a levelling spacer device able to facilitate the laying of slab products, such as tiles and the like, denoted in its entirety by the letter P and destined to clad surfaces, i.e. floors, walls, ceilings and the like.

The device 10 comprises a widened base 20, or example polygonal, circular or irregular in shape, defining a bottom surface 21, for example flat.

The bottom surface 21 can be rested on a layer of glue arranged on the underfloor surface that is to be clad by the tiles P or on a flat fixing plane, such as wood, plasterboard or the like.

The upper surface 22 of the base 20, also substantially flat, is instead destined to restingly receive a portion of the laying surface of one or more tiles P.

In practice, the base 20 is positioned beneath at least two (or more) adjacent tiles as will more fully emerge in the following.

In the illustrated example the base 20 is a monolithic body exhibiting a shape (in plan view) that is irregular, provided with a narrowed portion 231 and a broadened portion 232.

In practice, the broadened portion 232 exhibits a substantially triangular shape (with bevelled edges), for example an isosceles triangle (with a corner angle of 90°), from a base of which (opposite the corner) the narrowed portion 231 branches, in an opposite direction to the corner of the broadened portion 232.

The narrowed portion 231 exhibits, for example, a substantially quadrangular shape, for example substantially square with bevelled edges.

In practice, the narrowed portion 231 exhibits a transversal volume (defined on the side branching from the broadened portion) that is substantially smaller than the transversal volume of the broadened portion (defined by the base opposite the corner) from which it branches, and is connected at a central zone thereof, so as to define two free edges (i.e. two end portions of the base opposite the corner) of the broadened portion 232 which two free edges are located on opposite sides with respect to the narrowed portion 231.

The base 20 exhibits, for example, at least a lateral edge 24 inclined by an acute angle with respect to the bottom surface 21.

In the example two lateral edges 24 are defined, inclined, opposite and positioned at the free distal edges, respectively of the narrowed portion 231 and the broadened portion 232.

Each lateral edge 24 defines an inclined salient ramp which connects the bottom surface 21 to the upper surface 22 of the base 20.

In the illustrated example, the lateral edges 24 are equidistant from the centre of the base 20; further, the lateral edges 24 are parallel to the joining line (imaginary) between the narrowed portion 231 and the broadened portion 232 of the base 20 and therefore the line defined by the free ends of the broadened end.

The base 20 advantageously comprises a separator wall 25 that is plate-shaped and salient perpendicularly from the upper surface 22 of the base 20. The separator wall 25 is parallel to the join line (imaginary) between the narrowed portion 231 and the broadened portion 232 of the base 20 and therefore substantially aligned to the free edges of the broadened edge.

The separator wall 25 exhibits a height (much) smaller than the thickness of the tiles P to be laid.

The device 10 further comprises a separator element 30 which in use will go into contact at least with a portion of the facing flanks of at least two tiles P to be flanked when laid along a flanking direction denoted in the figures by the letter A.

The separator element 30 is a slab-shaped parallelepiped, for example having a rectangular base which defines a slim separator wall.

In particular, the separator element 30 comprises two lateral uprights 31 parallel to one another and superiorly joined by a cross-piece 310.

The two lateral uprights 31 are joined, at the opposite end to the cross-piece 310, to the base 20, as will more fully emerge in the following.

In practice, the separator element 30 is mobile between a storage position in which it lies substantially parallel to the base 20 and a work position in which it emerges substantially perpendicularly from the base, for example being aligned in plan view with a median line of the base (i.e. with the join line between the narrowed portion 231 and the broadened portion 232).

Further, the separator element 30 exhibits a greater height than the thickness of the tiles P to be laid, such that the top of the separator element in the work position, once the tiles P are resting on the upper surface 22 of the base 20, projects superiorly (by an abundant amount) with respect to the plane to be levelled, defined by the in-view surface of the tiles P.

Further, the separator element 30, due to the portal structure thereof, defines a through-window 32 passing from side to side in a transversal direction (laterally surrounded by the lateral uprights 31 and superiorly by the cross-piece 310), the upper border 33 of which is destined to be positioned superiorly of the level of the in-view surface of the tiles P to be levelled, when the separator element 30 is in the work position.

In practice, when the separator element 30 is in the work position the upper edge 33 of the through-window 32 is substantially aligned in plan view with the separator wall 25, the upper edge of which therefore defines the lower edge of the through-window.

Further, the through-window, in the preferred embodiment shown in the figures, is of such dimensions as to be able to house (substantially coplanarly and with play) the narrowed portion 231 of the base 20, when the separator element 30 is in the storage position.

The separator element 30 is preferably joined to the base 20 at the free ends of the broadened portion 232, such that the lateral uprights 31 laterally surround the narrowed portion when the separator element 30 is in the storage position (and the lower edge 33 of the through-window 32 is facing the lateral edge 24 of the narrowed portion 231).

The separator element 30 is joined to the base 20 by means of a fold line 34 substantially defining a hinge which enables rotation of the separator element 30 from the storage position to the work position (and possible vice versa). The fold line 34 is realized by a cut conformed substantially in a V-shape realized on the join line between the separator element 30 and the base 20. The V-cut advantageously exhibits a concavity facing on the opposite side with respect to the bottom surface 21 of the base, so as to facilitate the folding of the separator element 30.

In practice, when the separator element 30 is in the storage position, the V-cut is open, while the flanks thereof come into contact, substantially closing the cut, when the separator element 30 is in the work position.

The flanks of the V-cut are advantageously reciprocally inclined by a right-angle (for example each is inclined by 45° with respect to the upper surface 22 of the base 20).

Further, the separator element 30 exhibits a line or section that is pre-weakened and which in use will be arranged inferiorly of the level of the in-view surface of the tiles to be spaced and levelled, for example at a same level or lower (as in the illustrated example) than the upper surface 22 of the base 20.

With this pre-weakened line or section the emerging portion of the device 10 can easily be removed, once the tiles P have been laid and the glue supporting them has solidified.

The pre-weakened line or section preferably coincides with the fold line 34 and is defined by the V-cut.

In practice, the separator element 30 and the base 20 are realised in a single piece, for example by moulding of plastic materials, joined to one another by means of the narrowed section defined by the V-cut, which can be torn as required, as will more fully emerge in the following.

Further, the base 20 and the separator element 30 define a single-use throw-away body of the device 10, in which the base remains arranged, after use, hidden below the plane of the laid tiles P and the separator element 30, torn from the base 20, can be thrown away.

In particular, for the aims of the present invention, the device 10 comprises blocking means of the separator element 30 in the work position.

For example, the blocking means are of a releasable type or a temporary-blocking type.

The blocking means comprise at least an abutting shelf 250 fixed to at least one from between the base 20 and the separator element 30, which can interfere with at least a hooking element 311 solidly constrained to the other of the separator element 30 and the base 20.

In the illustrated examples, the blocking means comprise two abutting shelves 250 fixed to the base 20 and two hooking elements 311 fixed to the separator element 30, though the numbers thereof might be different, for example a single abutting shelf 250 and a single hooking element 311.

Each abutting shelf 250 is fixed to the separator wall 25, for example in such a way as to prolong the wall longitudinally by a limited axial amount which branches projectingly externally of the narrowed portion 231.

In practice, each abutting shelf 250 is substantially aligned in plan view to a free edge of the broadened portion 232.

Each abutting shelf 250 defines a front surface 251 facing towards the narrowed portion 231 (i.e. towards the separator element 30 when it is in a storage position) and a rear surface 252 facing towards the broadened portion 232.

Each abutting shelf 250 is substantially rigid or exhibits a slight elastic yieldability.

Each hooking element 311 is fixed to an upright 31 of the separator element 30, for example in such a way as to prolong it internally of the through-window 32 by a limited amount branching projectingly from the upright 31. Each hooking element 311 is substantially plate-shaped and, for example, is substantially rigid or exhibits a certain elastic yieldability.

In the illustrated examples, each hooking element 311 comprises a flexible and elastically-yielding plate, which can snap-fit resting on the abutting shelf 250, in particular on the rear surface 252 thereof, when the separator element 30 is in the work position, so as to prevent the spontaneous return of the separator element into the storage position.

In this case the abutting shelf 250 and the hooking element 311 of each side are substantially aligned along an imaginary circumference centred on the fold line 34.

In practice, in passing the separator element 30 from the storage position to the work position the hooking element 311, before coming into contact with the front surface 251 of the abutting shelf 250, then flexing, passes beyond the abutting shelf 250 and is brought into contact with the rear surface 252 of the abutting shelf 250 and remains blocked there.

The return of the separator element 30, blocked in the work position in which it is substantially at right-angles to the base 20, into the storage position is prevented by the abutting shelf 250, and at the same time tilting is prevented on the opposite side by the V-cut which limits the travel of the separator element substantially to the right angle.

Obviously the abutting shelf 250 might be flexible and elastically yieldable and the hooking element 311 might be substantially rigid or semi-rigid, or both might be flexible and elastically yieldable.

Further, and alternatively, the hooking element 311 might joint by mechanical friction with the abutting shelf 250 when the separator element 30 is in the work position.

In practice the hooking element 311 and the abutting element 250 might be configured in such a way as to go into reciprocal contact at the free ends thereof (distal from the respective ends respectively constrained to the lateral upright 31 and the separator wall 25) and are substantially aligned (along the axis of the separating wall) following a slight (plastic) deformation, in such a way that the spontaneous return of the separator element into the storage position is prevented by the reciprocal friction between the hooking element 311 and the abutting shelf 250.

The device 10 further comprises presser means associated to the separator element 30 able to press the in-view surface of the tiles P towards the base 20, such as to level the tiles.

Figure 19:
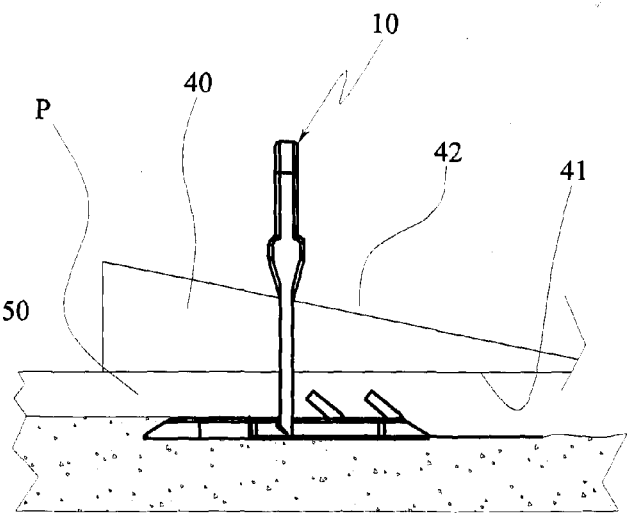
FIG. 19 is a lateral view of the device of FIG. 16 with a wedge inserted for levelling a slab product.
Figure 20:
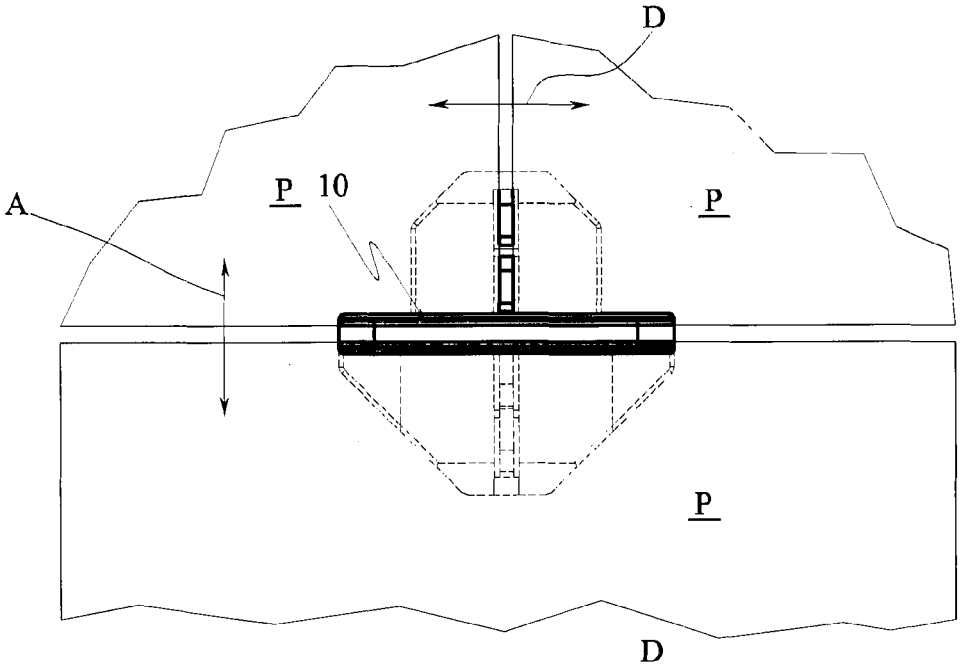
FIGS. 20 and 21 are views from above of the device of FIG. 16 with a possible arrangement of slab products and, respectively, before or after the inserting of the wedge for the levelling of the slabs.

In particular, as the presser means comprise, for example, a wedge element 40 (visible for the sake of simplicity only in FIGS. 19 and 21) provided with a flat lower surface 41 destined to be arranged, in use, parallel to the base 20 and an inclined upper surface 42 provided with abutting elements, such as teeth or knurling.

The wedge element 40 can be inserted internally of the through-window 32 and slide, with the lower surface 41 resting on the in-view surfaces of the tiles P, such that the upper surface 42 thereof goes into contact with the upper edge 33 of the through-window 32—for example in such a way that the teeth engage the upper edge—and the wedge element 40 is thus pressed against the tiles P by the thrust thereof towards the base 20.

The separator element 30 advantageously exhibits a reinforcement, for example a zone having a larger section (of any shape), positioned superiorly of the through-window 32 (or in the environs of the upper edge 33 thereof) able to prevent, in use, the flexion of the separator element when the wedge element 40 is forced into the through-window 32.

The wedge element 40 is, for example, a re-usable body of the device 10 that can be applied by insertion in a plurality of through-windows 32.

It is however possible for the presser means to comprise, alternatively, a block able to slide along the separator element and provided with teeth that can engage a suitable rack associated to the separator element or another system of known type able to impress a gradual and substantially uniform pressure at the in-view surface of the two or more flanked tiles P to be levelled.

In the second and fourth embodiments shown respectively in figures from 12 to 19 and in figures from 27 to 32, the device 10 advantageously comprises (as well as what is described in the foregoing) at least a corner spacer 50 which emerges from the base 20 at a right-angle with respect to the separator element 30.

Figure 21:
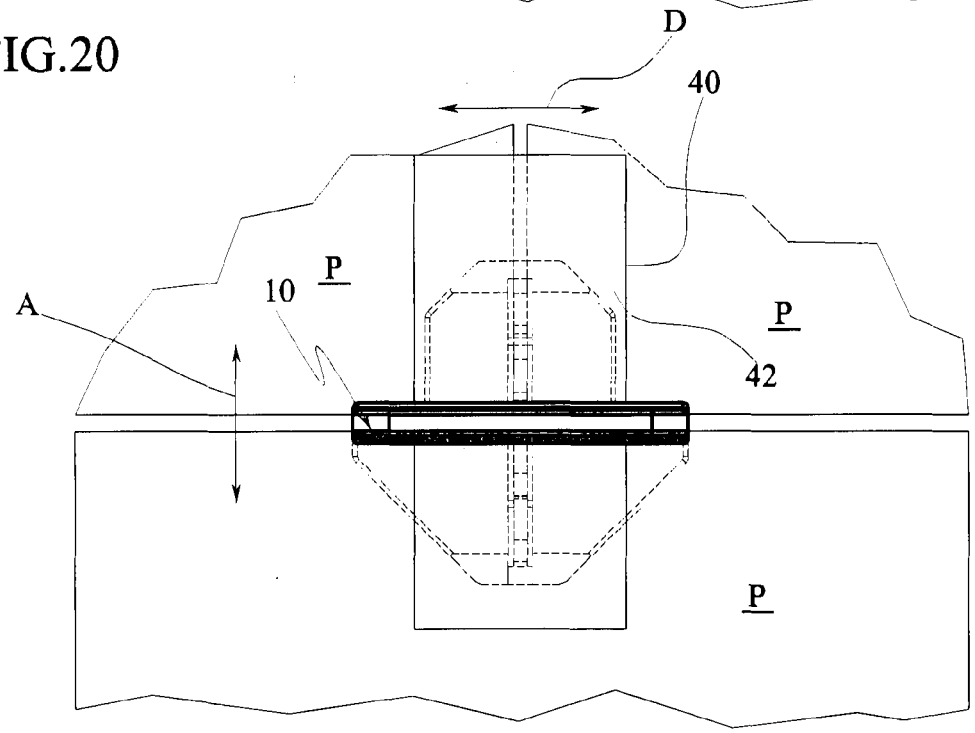
Figure 22:
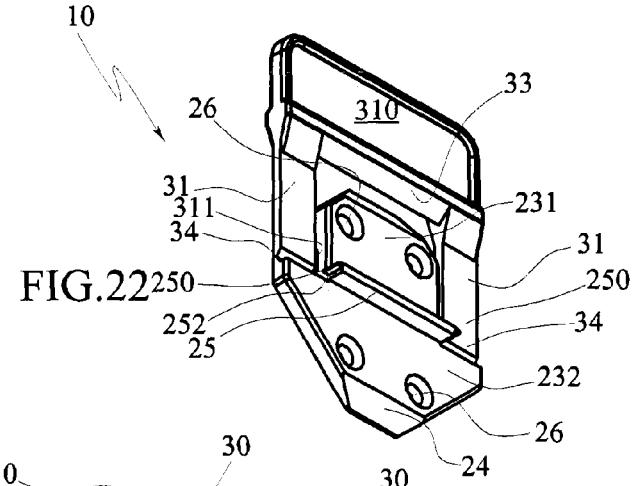
FIG. 22 is an axonometric view of a third embodiment of a levelling spacer device, according to the invention, in the storage position.
Figure 23:
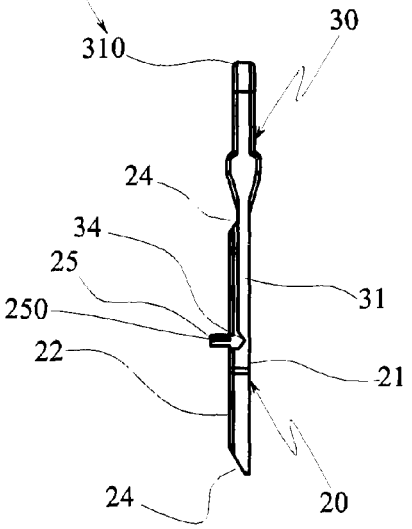
FIG. 23 is a lateral view of FIG. 22.
Figure 24:
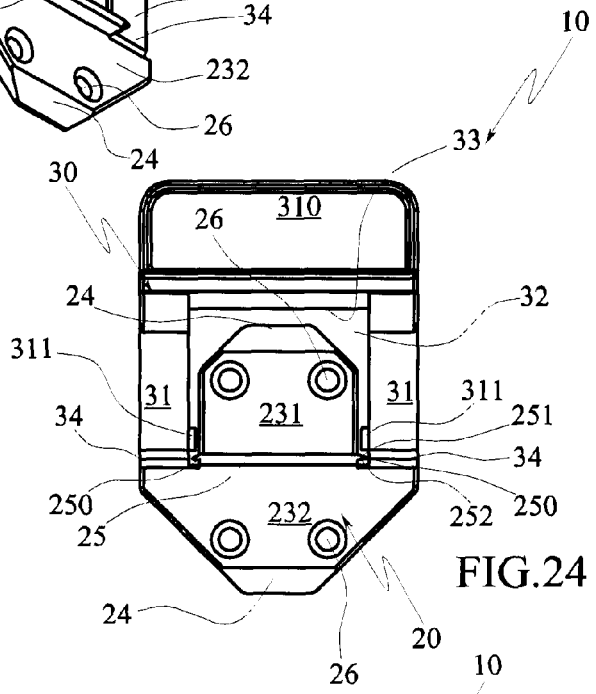
FIG. 24 is a view from above of FIG. 22.
Figure 25:
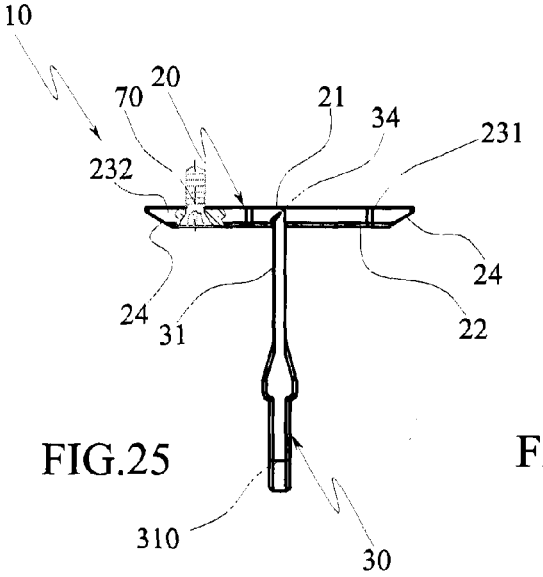
FIG. 25 is a lateral view of the levelling spacer device according to the third embodiment of the invention, in an operative work position.
Figure 26:
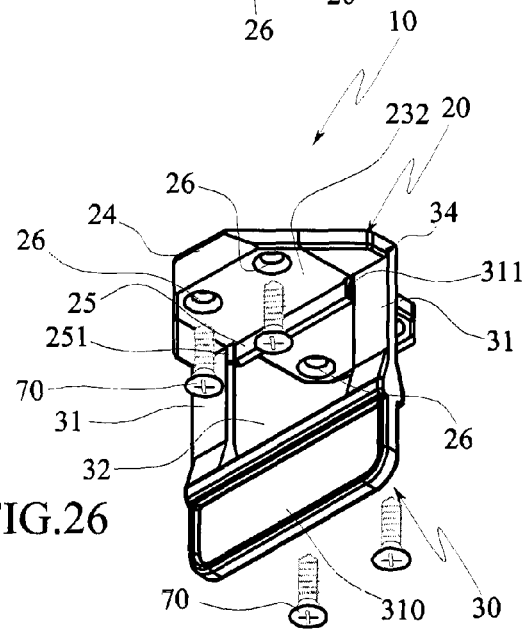
FIG. 26 is an axonometric view of FIG. 25.
Figure 27:
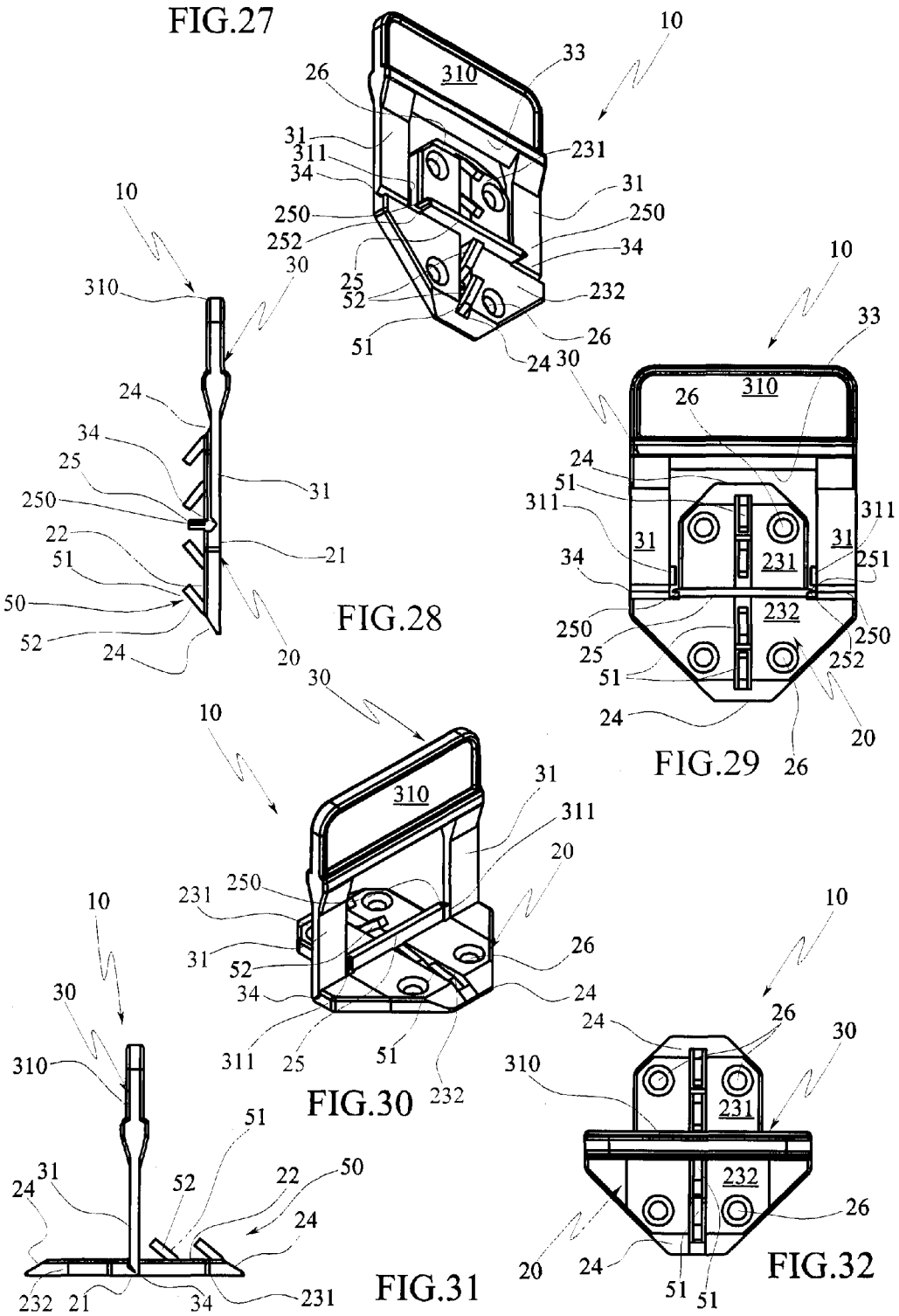
FIG. 27 is an axonometric view of a fourth embodiment of a levelling spacer device according to the invention, in the storage position.

In practice, in plan view the separator element 30 and the corner spacer 50 are arranged in cross-fashion, for example the corner element 50 is substantially aligned to the through-window 32 (along the flanking direction A), i.e. is arranged in the base in such a way that, in use, it can be arranged beneath the wedge element (see FIG. 21).

The corner spacer 50 is able to come into contact with the flanks perpendicular to the facing flanks of the tiles P for aligning them along a direction D perpendicular to the flanking direction A.

The corner spacer 50 is, advantageously but not limitedly, mobile between a raised position, in which it projects superiorly of the base 20 and is raised therefrom and a position of non-interference with the flanks perpendicular to the tiles P (with respect to direction D).

In practice, the corner spacer 50 can be configured such that in the configuration of non-interference it lowers, so that the vertical volume is contained totally or at least partially in the vertical volume (thickness) of the base 20.

In the example, the corner spacer 50 comprises at least a block 51 provided with two lateral flanks 52, which when the block 51 is in the raised position are able to come into contact with the flanks of two tiles P to be flanked along the direction D.

In the preferred embodiment shown in the figures, the block 51 is associated to the base 20 such that in the non-interference position the lateral flanks 52 are all contained within the vertical volume of the base 20, i.e. the block 51 is hidden in the base 20, and in the raised position the lateral flanks 52 emerge superiorly of the base in such a way that they can function as abutting elements for the flanks of the tiles P to be arranged at right-angles.

The thickness in plan view of the corner spacer 50 is advantageously equal to the thickness (horizontal) in plan view of the separator element 30 (in particular the lateral uprights 31), such that the tiles P are spaced both along the direction D and along the flanking direction A by a same distance.

It is however possible for the thickness in plan view of the corner spacer 50 to be different to the thickness in plan view of the separator element 30 according to the various laying requirements of the tiles P.

In the illustrated embodiments, the device 10 comprises, in the example, at least two corner spacers 50, as described above and independent of one another, which are arranged on an opposite side with respect to the separator element 30; in particular, in the illustrated example two pairs of corner spacers 50 are present, each pair being arranged on an opposite side with respect to the separator element 30.

The lateral flanks 52 of each corner spacer 50 are two-by-two substantially coplanar to one another and perpendicular to the lateral uprights 31 of the separator element 30, in such a way as to guarantee the effective alignment of the flanks of the tiles P along the direction D.

It is however possible for the device 10 to comprise, alternatively, a single corner spacer 50 which crosses the separator element 30 (for example through the window 32).

In a preferred embodiment shown in FIGS. 12-19 and 27-32 each block 51 is made of at least a plastically or elastically yielding material and branches projectingly from the base 20.

In practice, each block 51 exhibits a free end and the opposite end fixed to the base 20 and is made in a single piece with the base.

Owing to the yielding nature of the material the block 51 is made of, the block is arranged folded upwards by an acute angle in the raised position thereof, while it is arranged substantially coplanarly with the base 20 in the non-interfering or lowered position.

The angular spacers can be different from those shown in the figures; for example they can be telescopic, removable or the like, such as the ones described in European patent application no. EP2565346 in the name of the same Applicant, which is incorporated herein for reference purposes.

Figure 33A:
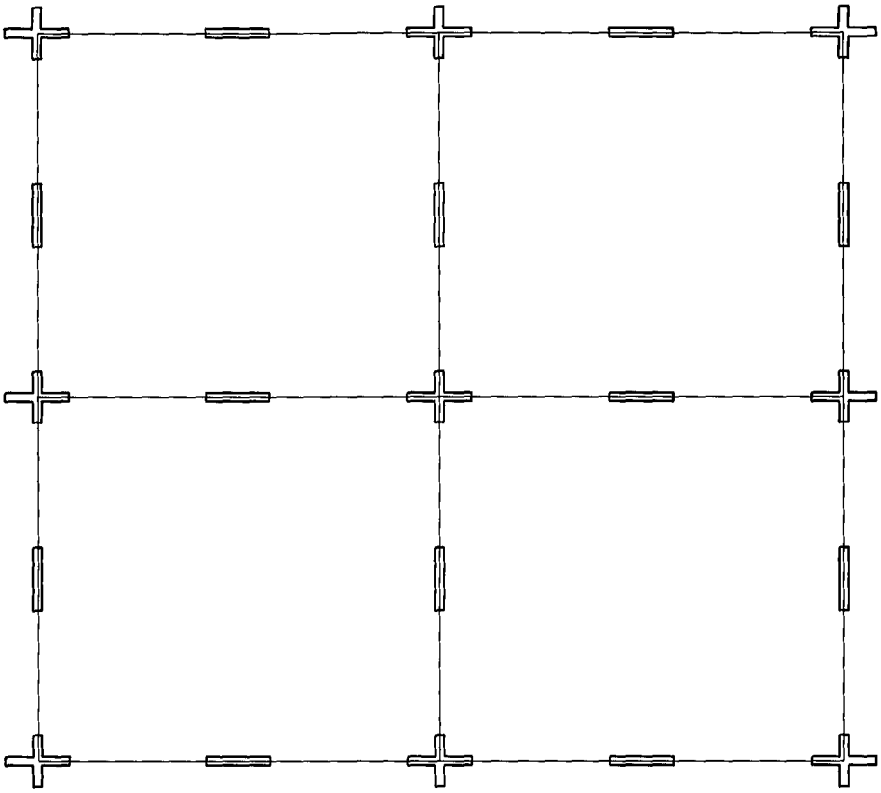
FIG. 33*a* is a schematic plan view of a first possible laying diagram of slab products, in a grid pattern.
Figure 33B:
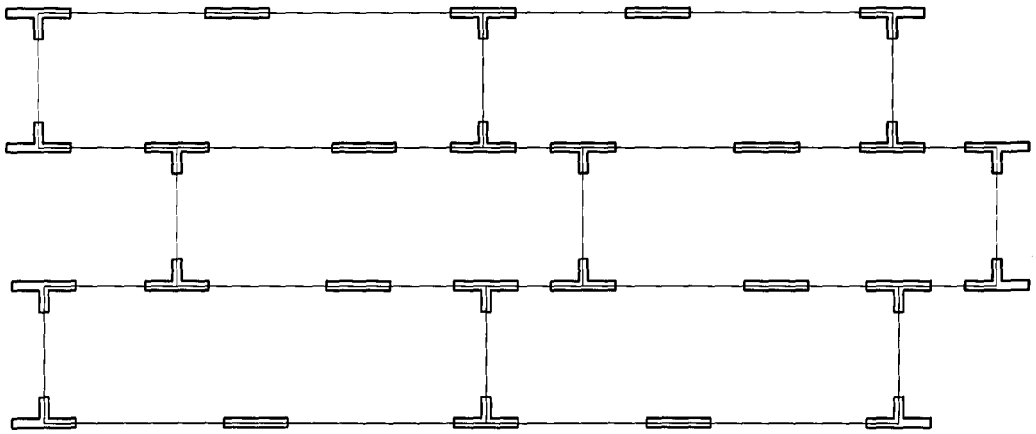
FIG. 33*b* is a schematic plan view of a second possible laying diagram of slab products, in a step pattern.
Figure 33C:
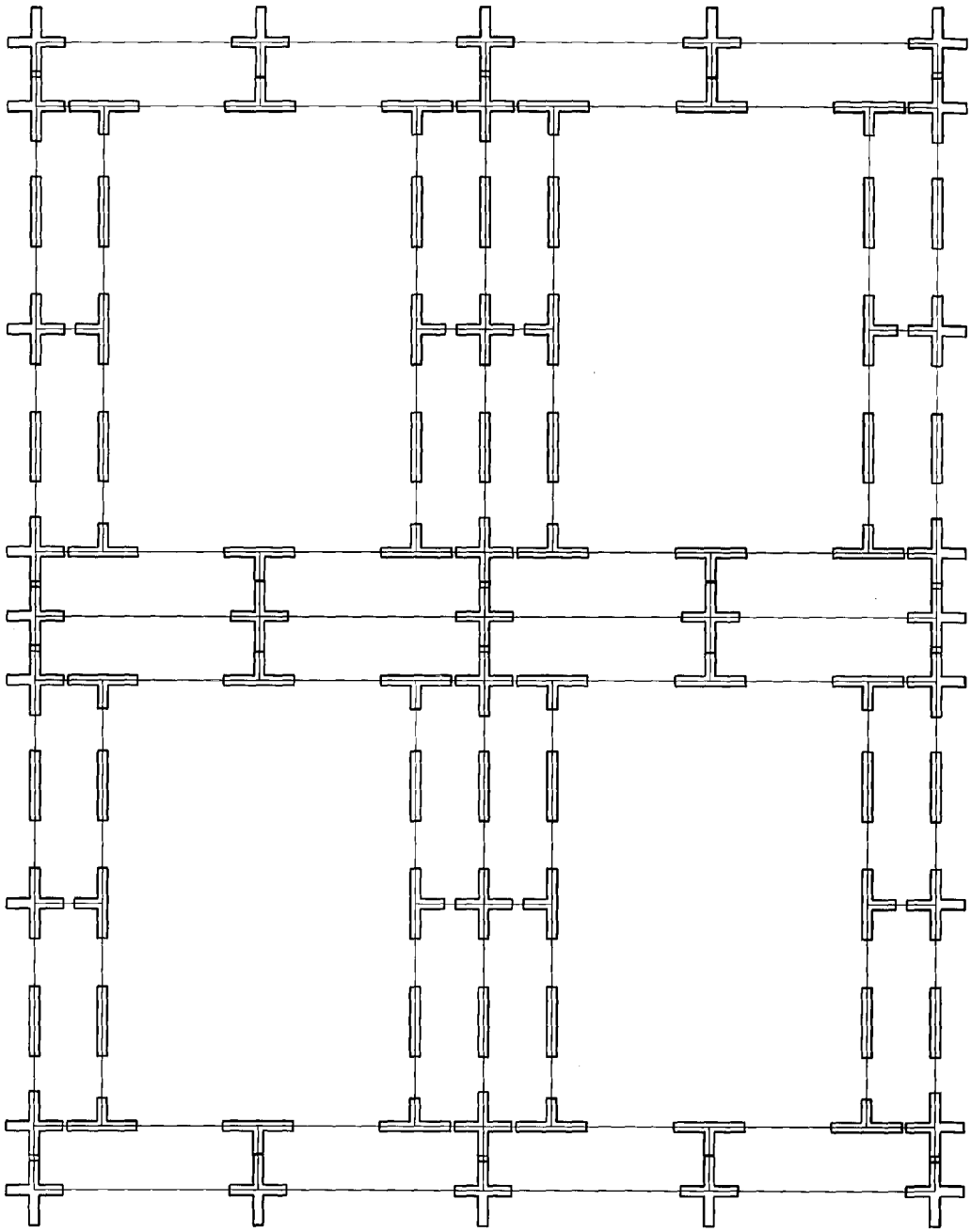
FIG. 33*c* is a is a schematic plan view of a third possible laying diagram of slab products, in a complex pattern.

In practice, thanks to the corner spacers 50 of mobile type, with a single device 10 it is possible to achieve more than one arrangement of the tiles P, for example with a conformation of the corner spacers 50 (emerging from the base) and the separator element 30 that is substantially in a cross, a T and/or straight; the same device 10 can be used in different zones of the tile, as is more clearly illustrated in FIGS. 33*a*, 33*b* and 33*c* in which three different possible known tile-laying patterns are illustrated.

Alternatively, the corner spacers 50 can be rigidly fixed to the base 20, as described in Italian patent application MO2002A000035 in the name of the same Applicant.

Additionally to, or alternatively to what has been described above in relation to the first and second embodiments, the device 10 in the third and fourth embodiments shown respectively in figures from 22 to 26 and figures from 27 to 32 advantageously exhibits at least a through-hole 26 in the base 20.

In the example four through-holes are illustrated, two at the narrowed portion 231 and two at the broadened portion 232, though they could also be in different numbers according to requirements.

The through-hole 26 has the function, in the case of laying the tiles P for flooring and cladding, of defining an access entry from below for the glue which can penetrate internally of the through-hole 26 and go into contact also with a portion of the laying surface of the tile superposed in plan view with the base 20, thus improving grip.

The through-hole 26 advantageously exhibits a variable section along the thickness of the base 20 and decreasing from the upper surface 22 of the base 20 towards the lower surface 21 of the base 20.

This characteristics, shown herein in the case of the devices 10 with a mobile separator element 30 provided with blocking means, can however be used in any type of levelling spacer device of known type, for example with the separator element mobile but lacking blocking means, or removable, with the separator element 30 rigidly fixed to the base 20, with presser systems of the screw-type or the cursor-type, as known to the expert in the sector. The through-holes 26, for example, exhibit a circular transversal section with inclined or stepped flanks, in such a way as to define a tapered abutting surface with respect to the mouth (defined at the upper surface 22).

In this way, the through-hole 26 can substantially invisibly house a head of a fastening organ, such as a screw 70 or a nail or another like fastening organ, which can fix the device 10 to an abutting plane, such as plasterboard, wood or the like, for example at a ceiling to be clad with slab-shaped elements such as, for example panels, tiles or the like.

In practice, the head of the screw 70 can interfere with the tapered abutting surface defined by the through-hole 26 and fasten it against the abutting plane and, at the same time, can be contained internally of the vertical volume (thickness) of the base 20, the upper surface 22 of which remains the only part in contact with the slab product to be laid.

In this case, the device 10 and the screws 70 define a levelling spacer system for laying slab products for cladding surfaces that is particularly suitable for cladding ceilings or suspended parts facing downwards.

In the light of the above, the functioning of the device 10 is the following.

The device 10 is produced and packed with the separator element 30 in the storage position.

In order to be used the device 10 must be brought into the work position; in practice the separator element 30 is brought from the storage position into the work position by rotating it with respect to the fold line 34 substantially by a right-angle.

When the separator element 30 is substantially inclined by a right-angle with respect to the base 20 (slightly smaller than a right-angle), the hooking element 311 is in contact with the front surface 251 of the abutting shelf 250; by continuing the rotation of the separator element 30 by a modest angle, the hooking element 30 flexes and passes beyond the abutting shelf 250 so as to be brought, then, to the opposite side resting on the rear surface 252 of the abutting shelf.

The hooking element 311, though flexible, exhibits a certain stiffness which enables the hooking element 311 to remain hooked to the abutting shelf 250 if not stressed, in practice remaining the separator element 30 blocked in the work position.

To clad a surface with a plurality of tiles P it is sufficient to spread a layer of glue thereon and then the tiles P can be laid.

In practice, when the first tile is to be laid, it is sufficient to position a first device 10, the base 20 of which is destined, for example, to be positioned below four corners of respective four tiles P.

Once the base 20 is positioned it is sufficient to position the four tiles P so that each corner thereof exhibits a portion of the lateral flank in contact respectively with a lateral upright 31 of the separator element 30 and with a lateral flank 52 of a pair of blocks 51.

In this way the squared arrangement is ensured as well as the equal distance between the four tiles surrounding the device 10. When for example the tiles P exhibit especially large dimensions, a device 10 can be positioned also at a median zone of the lateral flank of the tile.

In this configuration, the base 20 is positioned below two flanked tiles P, so that the lateral flank of each thereof rests on the lateral uprights 31 of the separator element 30.

In doing this, the tile P rests on one or more of the corner spacers 50, which is brought, for example thanks to the weight of the tile P or forced by the operator doing the laying, from the raised position to the non-interfering position in which it is lowered below the level of the upper surface 22 of the base 20.

It is possible, for example to lay first a tile P and then, at the corner or a flank of the tile, a portion of the base 20 of the device 10 is inserted.

Once positioned, the various bases 20 with the respective separator elements 30 and the corner spacers 50 as described above, when the glue is in any case not entirely solidified, the various wedge elements 40 completing the levelling spacer device 10 are inserted and press on the in-view surface of the tiles P locally at the various points (median or corner), enabling perfect levelling of the in-view surface of the tiles.

Lastly, when the glue has hardened and gripping the separator element 30 is broken along the pre-weakened point or line and the separator element 30 is then removed so that the spaces between the tiles P can be grouted without the base 20 being visible on the finished surface.

The invention as it is conceived is susceptible to numerous modifications and variants, all falling within the scope of the inventive concept.

Purely by way of example, FIGS. 34 and 35 respectively illustrate a first variant and a second variant of the device 10 (shown in the storage position), in which the reference numbers reported in the figures have been left unaltered with respect to the numbers used in figures from 1 to 32 for those structural elements of the device that are alike, analogous or which have the same function in the variants described in the following.

Figure 34:
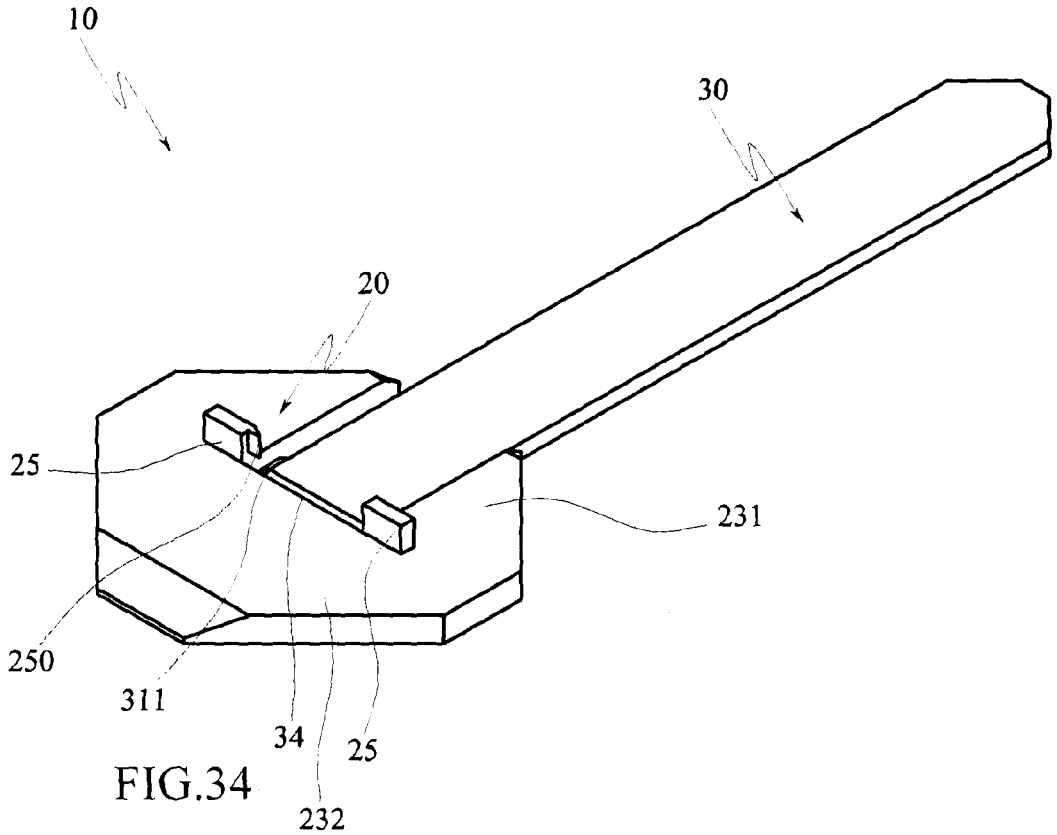
FIG. 34 is an axonometric view of a second variant of the levelling spacer device in the storage position, usable in combination with a presser element of a cursor type.

In the first variant of FIG. 34 the device 10 can be used for levelling the tiles P by means of use of a presser element of a cursor type.

The device 10 comprises a base 20 which in the illustrated example is a monolithic body exhibiting a shape (in plan view) that is irregular, provided with a forked portion 231 and a broadened portion 232.

In practice, the broadened portion 232 is entirely alike to the broadened portion of the first variant of the device 10.

The base 20 advantageously comprises a plate-shaped separator wall 25 rising perpendicularly from the upper surface of the base 20.

The separator wall 25 is parallel to the (imaginary) join line between the forked portion 231 and the broadened portion 232 of the base 20 and therefore is substantially aligned with the forked zone of the forked portion.

In practice, two separator walls 25 are present, coplanar and positioned on opposite sides with respect to the forked zone of the forked portion 231 of the base 20.

Each separator wall 25 has a height (much) smaller than the thickness of the tile P to be laid.

The device 10 further comprises a separator element 30 which in use can contact at least a portion of the facing flanks of at least two tiles P to be flanked when laid along a flanking direction indicated by the letter A in the figures.

The separator element 30 is a parallelepiped slab body, for example having a rectangular base, which defines a slim separator wall.

Further, the separator element 30 exhibits a greater height than the thickness of the tiles P to be laid, so that the top of the separator element in the work position, once the tiles P are resting on the upper surface 22 of the base 20, projects superiorly (abundantly) with respect to the plane to be levelled defined by the in-view surface of the tiles P.

The separator element 30 in the example is a substantially inextensible band, for example provided with reference notches or teeth for a cursor.

The separator element 30 is advantageously joined to the base 20 at the forked zone, such that the flaps of the forked portion 231 laterally surround the base portion of the separator element 30 when the separator element 30 is in the storage position.

The separator unit 30 is joined to the base 20 by means of a fold line 34 that substantially defines a hinge enabling rotation of the separator element 30 from the storage position to the work position (and possibly vice versa).

The fold line 34 is realised by a cut, substantially V-shaped and realized on the join line between the separator element 30 and the base 20.

The V-cut advantageously exhibits a concavity facing on the opposite side with respect to the lower surface of the base 20, so as to facilitate the folding of the separator element 30.

In practice, the V-cut, when the separator element 30 is in the storage position, is open, while the flanks thereof come into contact, substantially closing the cut, when the separator element 30 is in the work position.

The flanks of the V-cut are advantageously inclined to one another substantially by a right-angle (for example each is inclined by 45° with respect to the upper surface 22 of the base 20).

Further, the separator element 30 exhibits a pre-weakened line or section able in use to be arranged inferiorly of the level of the in-view surface of the tiles to be spaced and levelled, for example at the same level as or lower (as in the illustrated example) than the upper surface of the base 20.

Thanks to the pre-weakened line or section the emerging portion of the device 10 can be easily removed once the tiles P have been laid and the glue supporting them has solidified.

The predetermined pre-weakened line or section coincides, preferably, with the fold line 34 and is defined by the V-cut.

In practice, the separator element 30 and the base 20 are made in a single piece, for example by moulding of plastic materials, joined to one another by means of the narrowed section defined by the V-cut, which can be torn away as required and as will more fully emerge in the following.

The device 10 comprises blocking means of the separator element 30 in the work position entirely alike the blocking means described for the first variant of the device 10 described in the foregoing with reference to figures from 1 to 32.

In the example the blocking means comprise an abutting shelf 250 fixed to at least one from between the base 20 and the separator element 30, which is able to interfere with a hooking element 311 solidly constrained to the other from between the separator element 30 and the base 20.

The abutting shelf 250 is fixed to a separator wall 25 (or both separator walls 25), for example such as to longitudinally prolong it by a limited axial length branching projectingly internally of the forking zone.

In practice, each abutting shelf 250 is substantially aligned in plan view to a free edge of the broadened portion 232 which defines the forked zone.

The abutting shelf 250 is substantially rigid or exhibits a slight elastic yieldability.

The hooking element 311 is fixed to the separator element 30, for example such as to prolong it laterally by a limited length branching projectingly therefrom.

Each hooking element 311 is substantially slab-shaped and, for example, is substantially rigid or exhibits a certain elastic yieldability.

In the illustrated examples, each hooking element 311 comprises a flexible and elastically yielding plate, which is able to snap-fit resting on the abutting shelf 250, in particular on the rear surface thereof, when the separator element 30 is in the work position, such as to prevent the spontaneous return of the separator element into the storage position.

In this case the abutting shelf 250 and the hooking element 311 are substantially aligned along an imaginary circumference centred on the fold line 34.

In practice, the functioning of the second variant of the device 10 is entirely alike the functioning described for the first variant (FIGS. 1-32), to which reference is made for details.

Figure 35:
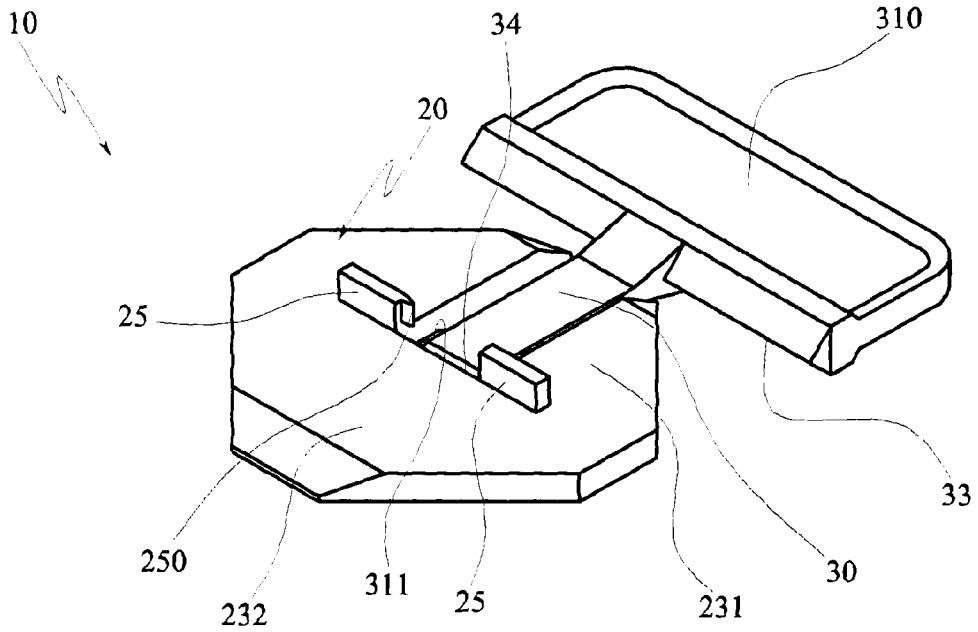
FIG. 35 is an axonometric view of a third variant of a levelling spacer device in combination with a wedge-shaped presser element with the forked end tapered.

The third variant of the device 10, shown in FIG. 35, differs from the second variant (FIG. 34) due to the fact that it is usable for the levelling of the tiles P with a presser element, for example, comprising a wedge (like the one illustrated for the first variant), but with the tapered end forked.

In this case the device 10 comprises a base 20 alike the one described above for the second variant of FIG. 34, from which a separator element 30 branches alike the one described for the second variant (to which reference is made for constructional details).

Blocking means are also comprised between the separator element 30 and the base, such as an abutting shelf 250 and a hooking element 311, identical to the ones described in the foregoing and functioning in the same way as described above.

The separator element 30 of the third variant of FIG. 35 differs from the separator element 30 of the second variant of FIG. 34 due to the fact that the band branching from the base 20 exhibits a smaller width and is such as to enter the fork present at the tapered end of the wedge.

Further, the separator element 30 comprises a cross-piece 310 at the free end thereof.

In practice the separator element 30 is substantially T-shaped.

The lower edges 33 of the cross-piece 310 (located on opposite sides with respect to the portion of separator element 30) which branches from the base are destined to be positioned superiorly of the level of the in-view surface of the tiles P to be levelled, when the separator element 30 is in the work position.

In practice, when the separator element 30 is in the work position each lower edge 33 is substantially aligned in plan view with a separator wall 25.

The forked wedge element can be inserted below the cross-piece 310 and run, with the lower surface resting on the in-view surface of the tiles P, such that the forked upper surface of the wedge element goes into contact with the lower edges 33 of the cross-piece 310—for example in such a way that the teeth engage therewith—and the wedge element is thus pressed against the tiles P for the pushing thereof towards the base 20.

The separator element 30 advantageously exhibits a reinforcement, for example a zone having a greater section (of any shape), positioned at the cross-piece 310 able to prevent, in use, the flexion of the separator element when the wedge element is forced below the cross-piece.

Further, all the details can be substituted by other technically equivalent elements.

In practice, the materials used, as well as the contingent shapes and dimensions, can be any according to requirements, without forsaking the scope of protection of the following claims.

The invention claimed is:

1. A levelling spacer device (10) for laying slab products (P) for cladding surfaces, said device (10) comprises a base (20), positionable on the backside of a laying surface of at least two slab products (P) that are adjacent and flanked with respect to a flanking direction (A), and at least a separator element (30) emerging from said base (20), wherein said separator element (30) is joined to the base (20), is able to contact the facing flanks of the two slab products (P), and is mobile between a storage position in which it lies substantially parallel to the base (20) and a work position in which it emerges substantially perpendicular to the base (20), further comprising blocking means (250, 311) of the separator element (30) in the work position, wherein the blocking means comprise at least an abutting shelf (250) fixed to at least one of the base (20) and the separator element (30), the abutting shelf (250) being able to interfere with at least a hooking element (311) solidly constrained to the other of the separator element (30) and the base (20) when the separator element (30) is in the work position, such as to prevent a spontaneous return of the separator element (30) into the storage position.

2. The device (10) of claim 1, wherein the hooking element (311) comprises a flexible elastically yielding plate projecting in cantilever fashion from at least one of the separator element (30) and the base (20) and able to snap-fit by resting on the abutting shelf (250) when the separator element (30) is in a work position such as to prevent a spontaneous return of the separator element (30) into the storage position.

3. The device (10) of claim 1, wherein the hooking element (311) and the abutting shelf (250) are able to joint by mechanical interference, being substantially flanked to one another when the separator element (30) is in the work position, such as to prevent, by reciprocal friction, a spontaneous return of the separator element into the storage position.

4. The device (10) of claim 1, wherein the separator element (30) is joined to the base (20) by means of a fold line (34) able substantially to define a hinge.

5. The device (10) of claim 4, wherein the fold line (340) is made by a substantially V-shaped cut realized in a join point between the separator element (30) and the base (20).

6. The device (10) of claim 1, further comprising presser means (40) associable to the separator element (30) and able to press the in-view surface of the slab products (P) towards the base (20) such as to level the products (P).

7. The device (10) of claim 6, wherein the separator element (30) comprises a slab body fixed to the base (20), provided with a through-window (32), an upper edge (33) of which, when in the operative work position, is destined to be placed above the level of the in-view surface of the slab products (P), the presser means comprising a wedge element (40) insertable internally of the window (32) and restingly slidable on the in-view surfaces of the slab products (P) in cooperation with the upper edge (34) for pushing the slab products towards the base (20).

8. The device (10) of claim 1, wherein the separator element (30) exhibits a line or section having a pre-weakened break line (35), which in use can be arranged below the level of the in-view surface of the slab products (P) to be spaced and leveled.

9. The device (10) of claim 8, wherein the pre-weakened line or section (35) substantially coincides with the fold line (340).

10. The device (10) of claim 8, wherein at least one of the pre-weakened line or section (35) and the fold line (340) is arranged at a height comprised in the thickness of the base (20).

11. The device (10) of claim 1, further comprising at least a corner spacer (50) which emerges from the base (20) at an angle with respect to the separator element (30) and is able to come into contact with the flanks perpendicular to the facing flanks of the slab products (P) such as to align the slab products (P) along a direction (D) that is perpendicular to the flanking direction (A).

12. The device (10) of claim 11, wherein the corner spacer (50) is mobile between a raised position, in which it projects above the base (20), and a non-interfering position with the flanks perpendicular to the slab products (P).

13. The device (10) of claim 11, wherein the corner spacer (50) is aligned with the window (32) along the flanking direction (A).

14. The device (10) of claim 1, wherein the base (20) comprises at least a through-hole (26) exhibiting a variable section along a thickness of the base (20) and decreasing from the surface of the base (20) destined to go into contact with the laying surface of the slab products (P) towards the opposite surface of the base.

* * * * *